United States Patent [19]

Jones et al.

[11] 4,014,684

[45] Mar. 29, 1977

[54] MANUFACTURE OF STEEL

[75] Inventors: Evan Thomas Richard Jones; Robert Anthony Fishburn, both of Birmingham, England

[73] Assignee: Foseco International Limited, Birmingham, England

[22] Filed: Nov. 14, 1974

[21] Appl. No.: 523,835

[30] Foreign Application Priority Data

Nov. 27, 1973 United Kingdom ..... 54995/73
Apr. 29, 1974 United Kingdom ..... 18713/74

[52] U.S. Cl. ..... 75/51; 75/53; 75/58; 75/94

[51] Int. Cl.² ..... C21C 7/02; C22B 9/10

[58] Field of Search ..... 75/51–58, 75/94

[56] References Cited

UNITED STATES PATENTS

| | | | |
|---|---|---|---|
| 3,410,681 | 11/1968 | Orban | 75/53 |
| 3,467,167 | 9/1969 | Mahin | 75/53 |
| 3,537,842 | 11/1970 | Holland | 75/58 |
| 3,567,432 | 3/1971 | Wardell | 75/53 |
| 3,575,695 | 4/1971 | Miyashita | 75/51 |
| 3,681,050 | 8/1972 | Ueki | 75/58 |
| 3,695,946 | 10/1972 | Demeaux | 75/58 |
| 3,748,121 | 7/1973 | Atterbury | 75/53 |
| 3,799,762 | 3/1974 | Cass | 75/51 |
| 3,802,865 | 4/1974 | Ohkubo | 75/53 |

OTHER PUBLICATIONS

Latimer & Hildebrand, "Reference Book of Inorganic Chemistry", 3rd ed., 1951, p. 327.

*Primary Examiner*—Peter D. Rosenberg
*Attorney, Agent, or Firm*—Cushman, Darby & Cushman

[57] ABSTRACT

The invention is concerned with the desulphurizing of molten ferrous metal by the use of a lime-based flux composition. The composition comprises, by weight, at least 60% of lime and includes from 1 to 20% of sodium carbonate, from 5 to 30% of an alkali metal or alkaline earth metal fluoride, typically fluorspar, and from 5 to 20% of alumina. To desulphurize molten metal the flux is added to the molten metal in a vessel, typically by injecting the flux in particulate form into the molten metal.

15 Claims, No Drawings

MANUFACTURE OF STEEL

This invention relates to treating molten metals, particularly to desulphurising molten ferrous metals, e.g. iron.

The presence of sulphur in steel has a detrimental effect on the surface quality and degree of cracking, and consequently on the degree of scarfing and grinding required and the yield achieved in the finishing process.

Particularly in the fields of brittle failure, welding and fabrication, steel requirements are becoming increasingly stringent, and sulphur can play an important and sometimes dominant role through its effect on steel properties.

Thus, the ever increasing emphasis on steel quality combined with the widening use of automatic production methods compel steelmakers to reduce sulphur levels to the absolute minimum that is economically practical.

With the exception of the double slag electric arc process, ultra low sulphur steels below 0.01% cannot be produced by conventional steelmaking processes unless special attention is given to ensure that the charge materials are low in sulphur.

Difficulties in achieving sulphur specifications due to the variable quality of these charge materials (and particularly steel scrap) often result in extra furnace time with the subsequent increase in steelmaking costs and reduction in productivity.

The increasing commercial demand for very low sulphur steels has resulted in the adoption of means for the external desulphurisation of molten iron, i.e. by means outside the blast furnace. Fortuitously, the demand for external desulphurisation has the unexpected advantage that the blast furnace may be operated at significantly lower basicities with the concomitant result that less limestone and coke are consumed and iron production is increased.

Several methods are already used for effecting external desulphurisation which include (1) stirring a desulphurising agent such as calcium carbide into the metal, (2) plunging desulphurising agents, e.g. magnesium impregnated into coke under the surface of the molten metal and (3) injecting particulate desulphurising agents, e.g. lime, calcium carbide, or calcium cyanamide into the metal.

All the methods mentioned above involve the desulphurisation of molten ferrous metal by treating the impure metal, in a suitable vessel, with an agent having known desulphurisation properties. The vessel in question may be, for example, a transfer ladle or holding ladle, a mixer vessel in which molten iron from the blast furnace is stored before conversion into steel, or a torpedo ladle.

We have now found that in a method of desulphurising molten metal in a vessel which comprises injecting into the molten metal a stream of a particulate flux, certain selected fluxes comprising lime, sodium carbonate, fluorspar and alumina form, on contact with the molten metal, a highly basic fluid slag which removes large quantities of sulphur from the molten metal. We have also found these selected fluxes to be useful when an injection technique is employed.

Accordingly, the present invention provides a flux composition for use in desulphurising molten metal, which composition comprises by weight, at least 60% of lime, from 1 to 20% of sodium carbonate, from 5 to 30% of an alkali metal or alkaline earth metal fluoride or a mixture thereof and from 5 to 20% of alumina.

The invention also includes a method of desulphurising molten metal in a vessel, which method comprises adding to the molten metal a flux composition in accordance with the invention.

The method of the invention is particularly effective in the case of iron and steel, and the vessel in which the treatment is carried out may be any of those described above.

Preferably, the fluoride is fluorspar and the invention is described below in terms of using this material. It is to be understood, however, that other alkali metal or alkaline earth metal fluorides may be used to replace fluorspar. For example, fluorspar may be wholly or partly replaced by sodium fluoride.

Preferably, the proportions of the ingredients in the flux composition are in the following ranges (by weight):

lime: 60 – 80%;
sodium carbonate: 5 – 10%;
fluorspar: 10 – 25%;
alumina: 5 – 15%, for example, 5 to 10%.

It is highly preferred, in order to enhance the desulphurisation potential of this composition, to include in the flux a small amount, typically up to 5% by weight of the flux, of a metallic reducing agent, i.e. an easily oxidised metal. Examples of such materials which may be incorporated are aluminium, magnesium, ferrosilicon, calcium silicide, calcium, cerium, silicon; or alloys or mixtures of these metals. Of these, aluminium or an aluminium alloy is preferred. Such a reducing agent should preferably constitute less than 2% by weight of the flux composition. Under the conditions of use, the molten metal is deoxidised by the aluminium or other reducing agent and strong reducing conditions are promoted. The oxidation of, for example, the aluminium is highly exothermic and this, together with the fluorspar and alumina of the compositions, leads to the formation of a fluid mobile slag. The sodium carbonate also helps to form the fluid slag.

If desired, alumina and aluminium may be present together as ball mill dust in the composition.

A further method of enhancing the reducing effect of the composition is to inject the composition in a medium containing, and which may consist wholly of, a reducing gas. Thus, while injection may be effected simply using compressed air, nitrogen or argon, it is preferable to use propane, natural gas or the like to give a reducing atmosphere.

The amount of composition used will vary widely with the type of metal in question, its previous treatment, sulphur content and the desired final amount of sulphur present. Typically, for a 40 tonne ladle the composition could be injected in propane (at a dilution of e.g. 45 kg composition per cubic meter of propane) at an addition rate of 3 to 10 kg flux composition per tonne of metal to be treated.

The following examples will serve to illustrate the invention. For comparison, it is observed that if lime is used at an application rate of 20 kg/tonne, injected (for a 40 tonne ladle) over a period of 10 minutes, then with a starting sulphur level of 0.020%, sulphur removal of 8 to 10 points is obtained (i.e. the content reduced to 0.012 to 0.010% respectively).

EXAMPLE 1

A flux composition was made up of (by weight):
lime: 60%;
sodium carbonate: 10%;
fluorspar: 22%;
alumina: 6%;
aluminium powder: 2%.

Using this composition, the following tests were performed:

TEST 1

6.25 kilograms of this composition/tonne were injected into a 40 tonne ladle of molten iron. The additive, carried on a stream of propane gas, was injected over a period of 4 minutes. Analysis showed the initial sulphur level to be 0.022%. After completion of the process the final sulphur level was 0.006%, i.e. 16 points of sulphur removal.

TEST 2

4.5 kilograms of this composition/tonne were injected into a 40 tonne ladle of molten iron. Injection time was about 4 minutes. Starting sulphur content was 0.038%, finishing sulphur content 0.026%. Thus, sulphur removal was 12 points.

It is clear from these tests that, even at much lower application rates, sulphur removal is much improved compared to the standard use of lime alone. The lower application rates lead, in turn, to a substantial saving in time, and in temperature losses from the molten metal.

EXAMPLE 2

A further flux composition according to the invention is as follows (by weight):
lime: 62%;
fluorspar: 20%;
sodium carbonate: 10%;
alumina: 7%;
aluminium: 1%.

Comparable results with those of Example 1 were determined using the composition at corresponding application rates.

For example, the composition was added at regular intervals into a hot metal ladle at an application rate of 7 kg/tonne. The starting sulphur content was 0.040% and the finishing sulphur content was 0.024% thus giving the removal of 16 points of sulphur.

EXAMPLE 3

Desulphurisation tests were carried out using a flux of the following composition:
lime: 63%;
fluorspar: 22%;
sodium carbonate: 5%;
alumina: 10%.
which was thrown into the ladle at a rate of 5 kg/tonne.

The results obtained were as follows:

| | Starting Sulphur % | Finishing Sulphur % |
|---|---|---|
| TEST 1 | 0.040 | 0.020 |
| TEST 2 | 0.042 | 0.020 |

EXAMPLE 4

Desulphurisation tests were carried out using a flux of the composition:
lime: 75%;
fluorspar: 15%;
sodium carbonate: 5%;
alumina: 5%.
which was added to a 180 tonne ladle of 0.1% carbon, silicon/aluminium killed steel at a rate of 8 kg/tonne. The starting sulphur was 0.030% whereas the finishing sulphur was 0.015%.

We claim as our invention:

1. A flux composition for use in desulphurising molten metal, which composition comprises, by weight, at least 60% of lime, from 1 to 20% of sodium carbonate, from 5 to 30% of a fluoride selected from alkali metal and alkaline earth metal fluorides and mixtures thereof, from 0 to less than 2% by weight of metallic reducing agent and from 5 to 20% of alumina.

2. A flux composition as claimed in claim 1 in which the fluoride is fluorspar.

3. A flux composition as claimed in claim 1 in which the fluoride is sodium fluoride.

4. A flux composition as claimed in claim 1, which contains from 60 to 80% by weight of lime.

5. A flux composition as claimed in claim 1, which contains from 5 to 10% by weight of sodium carbonate.

6. A flux composition as claimed in claim 1, which contains from 10 to 25% by weight of fluorspar.

7. A flux composition as claimed in claim 1, which contains from 5 to 15% of alumina.

8. A flux composition as claimed in claim 1 wherein the metallic reducing agent is selected from aluminium and aluminium containing alloys.

9. A method of desulphurising molten metal in a vessel, which method comprises adding to the molten metal a flux composition as claimed in claim 1.

10. A method as claimed in claim 9, wherein a stream of the flux composition in particulate form is injected into the molten metal.

11. A method as claimed in claim 9, wherein the flux composition in particulate form is injected into the molten metal in a medium containing a reducing gas.

12. A method as claimed in claim 9, wherein the flux composition in particulate form is injected into the molten metal in a medium containing a reducing gas selected from propane and natural gas.

13. A method as claimed in claim 9 wherein the metal is selected from iron and steel.

14. A method as claimed in claim 9 wherein the vessel is a ladle.

15. A flux composition according to claim 1 consisting essentially of 60–80% lime, 5–10% sodium carbonate, 10–25% fluorospar and 5–15% alumina.

* * * * *